US009340330B2

(12) United States Patent
LeBoeuf et al.

(10) Patent No.: US 9,340,330 B2
(45) Date of Patent: May 17, 2016

(54) STORAGE CONTAINER LIDS

(75) Inventors: William E. LeBoeuf, Midland, MI (US); Robert T. Schofield, Brooklyn, WI (US); Sean T. Petersen, Evansville, WI (US); James C. Boda, Merrimac, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 502 days.

(21) Appl. No.: 12/801,764

(22) Filed: Jun. 24, 2010

(65) Prior Publication Data

US 2011/0315702 A1 Dec. 29, 2011

(51) Int. Cl.
*B65D 41/18* (2006.01)
*B65D 43/02* (2006.01)

(52) U.S. Cl.
CPC .... *B65D 43/0208* (2013.01); *B65D 2543/0037* (2013.01); *B65D 2543/0074* (2013.01); *B65D 2543/00194* (2013.01); *B65D 2543/00296* (2013.01); *B65D 2543/00314* (2013.01); *B65D 2543/00509* (2013.01); *B65D 2543/00555* (2013.01); *B65D 2543/00564* (2013.01); *B65D 2543/00648* (2013.01); *B65D 2543/00685* (2013.01); *B65D 2543/00796* (2013.01); *B65D 2543/00805* (2013.01); *B65D 2543/00842* (2013.01); *B65D 2543/00972* (2013.01)

(58) Field of Classification Search
USPC ..... 220/793, 796, 795, 782, 200, 326, 220/256.1
See application file for complete search history.

(56) References Cited

U.S. PATENT DOCUMENTS

| | | | | |
|---|---|---|---|---|
| 1,380,908 | A | | 6/1921 | Hothersall |
| 2,047,720 | A | | 7/1936 | Wilhelm |
| 2,117,807 | A | | 5/1938 | Jesser |
| 2,674,390 | A | | 4/1954 | Meyer |
| 2,711,840 | A | | 6/1955 | Gits et al. |
| 2,723,142 | A | | 11/1955 | Stebbins |
| 3,351,227 | A | | 11/1967 | Collie |
| 3,353,708 | A | | 11/1967 | Davis |
| 3,397,814 | A | * | 8/1968 | Zackheim ..... 220/792 |
| 3,424,342 | A | | 1/1969 | Scoop et al. |
| 3,447,714 | A | | 6/1969 | Elliot |
| 3,458,079 | A | | 7/1969 | Gasbarra |
| 3,664,544 | A | | 5/1972 | Hammes |
| 3,688,942 | A | | 9/1972 | Mitchell et al. |
| 3,716,180 | A | | 2/1973 | Bemiss et al. |
| 3,732,909 | A | | 5/1973 | Rooke et al. |

(Continued)

FOREIGN PATENT DOCUMENTS

| | | | |
|---|---|---|---|
| GB | 2 317 379 | A | 3/1998 |
| WO | WO 2009/070490 | A1 | 6/2009 |

*Primary Examiner* — Jeffrey Allen

(57) ABSTRACT

The invention is directed to storage containers and lids for storage containers which provide for a secure closure and a storage container which is airtight and leakproof. The lid includes a generally U-shaped closure made of a plastic material for securing to a container base; a center window also made of a plastic material and preferably the same as the U-shaped closure; and a thermoplastic material which provides for a sealing gasket on the underside of the U-shaped closure for mating with the container base and a perimeter seal on the outside of the U-shaped closure and around the outer circumference of the center window. The lid may further include a gripping tab made at least in part of thermoplastic material in the lid corner for opening or closing the container, and wings made of a thermoplastic material in one or more portions or corners of the lid.

13 Claims, 9 Drawing Sheets

(56) References Cited

U.S. PATENT DOCUMENTS 3,773,208 A 11/1973 Curry
3,792,797 A 2/1974 Mrusek et al.
3,799,427 A 3/1974 Goglio
3,851,788 A 12/1974 Hammes
3,956,550 A 5/1976 Sutch
4,078,696 A 3/1978 Crisci
4,090,004 A 5/1978 Tebbutt et al.
4,134,535 A 1/1979 Barthels et al.
4,166,548 A 9/1979 Crisci
4,177,930 A 12/1979 Crisci
4,177,934 A 12/1979 Hammes et al.
4,206,870 A 6/1980 DeVries
4,220,254 A 9/1980 Morton et al.
4,238,047 A 12/1980 Helms et al.
4,347,947 A 9/1982 Hammes
4,434,910 A 3/1984 Groult
4,444,219 A 4/1984 Hollenstein
4,457,447 A 7/1984 Kirkis
4,494,674 A 1/1985 Roof
4,555,056 A 11/1985 Bernhardt
D285,906 S 9/1986 Tyler
D287,573 S 1/1987 Tyler
4,653,661 A 3/1987 Buchner et al.
4,674,644 A 6/1987 Jacobs
4,674,650 A 6/1987 Hamilton et al.
4,718,571 A 1/1988 Bordner
4,846,366 A 7/1989 Satz
4,865,854 A 9/1989 Larson
4,877,150 A 10/1989 Otto et al.
4,878,595 A 11/1989 Uhlig
4,886,184 A 12/1989 Chamourian
4,887,736 A 12/1989 VanCucha
4,890,637 A 1/1990 Lamparter
4,946,064 A 8/1990 VanCucha
4,976,370 A 12/1990 Cassel
5,065,885 A 11/1991 Scaroni
5,074,428 A 12/1991 Wildfeuer
5,163,576 A 11/1992 Galer
5,263,777 A 11/1993 Domke
5,326,176 A 7/1994 Domke
5,354,133 A 10/1994 Rapparini
5,361,928 A 11/1994 Stolzman
5,377,860 A 1/1995 Littlejohn et al.
5,383,565 A 1/1995 Luch
5,427,264 A 6/1995 Addison
5,427,266 A 6/1995 Yun
D360,105 S 7/1995 Doxey
D363,663 S 10/1995 Plater
D375,654 S 11/1996 Ferris
5,584,409 A 12/1996 Chemberlen
5,587,192 A 12/1996 Beizermann
D378,563 S 3/1997 Ferris
5,607,709 A 3/1997 Fritz et al.
D382,795 S 8/1997 Abayhan et al.
5,665,408 A 9/1997 Coupe et al.
5,686,127 A 11/1997 Stockley, III et al.
D388,325 S 12/1997 Tucker et al.
D390,109 S 2/1998 Tucker et al.
5,730,313 A 3/1998 Hayes et al.
5,772,070 A 6/1998 Hayes et al.
5,782,266 A 7/1998 Domke
5,785,201 A 7/1998 Bordner et al.
5,806,703 A 9/1998 Grandi
5,839,598 A * 11/1998 Mitchell ..... 220/321
D411,741 S 6/1999 Wilson et al.
5,944,211 A * 8/1999 Woodnorth et al. ..... 220/203.13
5,947,320 A 9/1999 Bordner et al.
5,989,608 A 11/1999 Mizuno
5,992,679 A 11/1999 Porchia et al.
D418,716 S 1/2000 Haley
D419,829 S 2/2000 Wilson et al.
6,032,827 A 3/2000 Zettle et al.
6,056,138 A 5/2000 Chen
6,068,898 A 5/2000 Oyama
D427,063 S 6/2000 May
D427,769 S 7/2000 Zimmerman
D428,310 S 7/2000 Zettle et al.
6,089,271 A 7/2000 Tani
D428,777 S 8/2000 Hayes et al.
D432,858 S 10/2000 Hayes et al.
D432,859 S 10/2000 Hayes et al.
6,152,318 A 11/2000 Walker
6,168,044 B1 1/2001 Zettle et al.
6,170,691 B1 1/2001 Morris, Sr. et al.
6,170,696 B1 1/2001 Tucker et al.
6,196,404 B1 3/2001 Chen
D440,470 S 4/2001 Tucker et al.
D440,830 S 4/2001 Tucker et al.
D443,184 S 6/2001 Maxwell et al.
D443,798 S 6/2001 Tucker et al.
D445,649 S 7/2001 Maxwell et al.
D446,077 S 8/2001 Tucker et al.
D446,117 S 8/2001 Conti
D447,382 S 9/2001 Tucker et al.
D448,288 S 9/2001 Zettle et al.
D448,606 S 10/2001 Conti
D448,991 S 10/2001 Zettle et al.
D449,495 S 10/2001 Tucker et al.
D450,983 S 11/2001 Tucker et al.
6,380,524 B1 4/2002 Keller
6,401,957 B1 6/2002 Przytulla
D462,880 S 9/2002 Maxwell et al.
6,460,716 B1 10/2002 Wong
6,467,647 B1 10/2002 Tucker et al.
6,478,181 B1 11/2002 Krupa et al.
D466,299 S 12/2002 Zimmerman
6,557,462 B1 5/2003 Wang
6,588,618 B1 7/2003 Davis
D478,469 S 8/2003 Roth et al.
6,644,494 B2 11/2003 Hayes et al.
6,662,827 B1 12/2003 Clougherty et al.
6,663,284 B2 12/2003 Buckingham et al.
D485,468 S 1/2004 Roth et al.
D485,473 S 1/2004 Dais et al.
6,677,016 B2 1/2004 Riffer
6,708,839 B2 3/2004 Diesterbeck
D489,530 S 5/2004 Lindsay
D489,975 S 5/2004 Jackson et al.
D490,278 S 5/2004 Welsh
6,733,852 B2 5/2004 Littlejohn et al.
6,793,096 B1 9/2004 Seok
6,814,991 B2 11/2004 Hiyoshi
6,834,772 B1 12/2004 Thorso
6,845,877 B2 1/2005 Diesterbeck
6,845,878 B2 1/2005 Hayes et al.
D502,060 S 2/2005 Dais et al.
D502,394 S 3/2005 Jackson et al.
6,868,980 B2 3/2005 Schultz et al.
D505,839 S 6/2005 Stanos et al.
D506,106 S 6/2005 Ordiway et al.
6,910,599 B2 6/2005 Tucker et al.
6,923,338 B2 8/2005 Dees et al.
D512,278 S 12/2005 Schultz et al.
7,004,632 B2 2/2006 Hamilton et al.
D516,859 S 3/2006 Zettle et al.
7,017,775 B2 3/2006 Zettle et al.
7,032,773 B2 4/2006 Dees et al.
D521,380 S 5/2006 Jackson et al.
7,063,231 B2 6/2006 Stanos et al.
7,074,443 B2 7/2006 Thomas et al.
7,080,754 B2 7/2006 Lown
7,090,089 B2 8/2006 Lown et al.
7,097,063 B2 8/2006 Tucker et al.
7,097,066 B2 8/2006 Tucker et al.
7,097,067 B2 8/2006 Scarabelli et al.
D531,798 S 11/2006 Ringo
D542,100 S 5/2007 Kim
D544,762 S 6/2007 Zimmerman
7,240,796 B2 7/2007 Murray
7,261,219 B2 8/2007 Tucker et al.
7,264,135 B2 9/2007 Savicki et al.
7,284,673 B2 10/2007 Habeger et al.
D555,983 S 11/2007 Tucker et al.
7,294,354 B2 11/2007 Gunter et al.

(56) References Cited

U.S. PATENT DOCUMENTS

| | | | | |
|---|---|---|---|---|
| 7,299,941 | B2 | 11/2007 | McMahon, III et al. | |
| 7,331,715 | B2 | 2/2008 | Miller et al. | |
| 7,357,272 | B2 | 4/2008 | Maxwell | |
| D568,693 | S | 5/2008 | Furlong | |
| D568,694 | S | 5/2008 | Furlong | |
| D573,846 | S | 7/2008 | Moghavem | |
| D575,115 | S | 8/2008 | Zimmerman | |
| D585,699 | S | 2/2009 | Furlong | |
| D586,179 | S | 2/2009 | Furlong | |
| D587,566 | S | 3/2009 | Albrecht | |
| D588,417 | S | 3/2009 | Doliwa | |
| 2002/0148847 | A1 | 10/2002 | Luburic | |
| 2002/0175173 | A1 | 11/2002 | Diesterbeck | |
| 2003/0015542 | A1 | 1/2003 | Nulty et al. | |
| 2003/0019878 | A1 | 1/2003 | Scarabelli et al. | |
| 2003/0116572 | A1 | 6/2003 | Klock et al. | |
| 2004/0026435 | A1 | 2/2004 | Skov et al. | |
| 2004/0084464 | A1 | 5/2004 | Koo | |
| 2005/0006390 | A1* | 1/2005 | Wang | 220/326 |
| 2005/0224506 | A1 | 10/2005 | Withers | |
| 2005/0269339 | A1 | 12/2005 | Ciccone | |
| 2006/0032858 | A1 | 2/2006 | Lee et al. | |
| 2006/0081641 | A1 | 4/2006 | Habeger et al. | |
| 2006/0175335 | A1 | 8/2006 | Easterday et al. | |
| 2006/0186014 | A1 | 8/2006 | Ramanujam et al. | |
| 2006/0186130 | A1 | 8/2006 | Jatzke et al. | |
| 2006/0199911 | A1 | 9/2006 | Markovich et al. | |
| 2006/0254948 | A1 | 11/2006 | Herbert et al. | |
| 2007/0007298 | A1 | 1/2007 | Tucker et al. | |
| 2007/0012710 | A1 | 1/2007 | Vovan | |
| 2007/0095837 | A1 | 5/2007 | Meier | |
| 2007/0119743 | A1 | 5/2007 | Tucker et al. | |
| 2007/0131701 | A1 | 6/2007 | Herbert et al. | |
| 2007/0138180 | A1 | 6/2007 | Vovan | |
| 2007/0187277 | A1 | 8/2007 | Furlong | |
| 2007/0219508 | A1 | 9/2007 | Bisegna et al. | |
| 2007/0221605 | A1 | 9/2007 | Pugne et al. | |
| 2007/0278221 | A1 | 12/2007 | Skaife | |
| 2008/0041850 | A1 | 2/2008 | Tucker et al. | |
| 2008/0041852 | A1 | 2/2008 | Cai | |
| 2008/0041858 | A1 | 2/2008 | Furlong et al. | |
| 2008/0047960 | A1 | 2/2008 | Albrecht | |
| 2008/0073312 | A1 | 3/2008 | Babcock et al. | |
| 2008/0073368 | A1 | 3/2008 | Custer et al. | |
| 2008/0110911 | A1 | 5/2008 | Chen | |
| 2008/0149641 | A1 | 6/2008 | Segal | |
| 2008/0171999 | A1 | 7/2008 | Baplue et al. | |
| 2008/0187631 | A9 | 8/2008 | Krueger et al. | |
| 2008/0203096 | A1 | 8/2008 | Maxwell | |
| 2009/0000977 | A1 | 1/2009 | Coonce | |
| 2009/0084805 | A1 | 4/2009 | Bryson et al. | |
| 2010/0237070 | A1* | 9/2010 | Coonce et al. | 220/203.29 |

* cited by examiner

STORAGE CONTAINER LIDS

CROSS REFERENCE TO RELATED APPLICATIONS

Not applicable.

REFERENCE REGARDING FEDERALLY SPONSORED RESEARCH OR DEVELOPMENT

Not applicable.

SEQUENTIAL LISTING

Not applicable.

FIELD OF INVENTION

The present invention relates to storage containers and lids therefor. More particularly, the invention is directed to storage containers for food and the like which containers are airtight and leakproof. The lids for the storage containers are generally characterized by having a hard plastic material and a soft thermoplastic material providing improved sealing, durability and aesthetics.

BACKGROUND OF INVENTION

Storage containers include an open-top base for storage and a lid to close the base. The lid and base mate to define the closure and seal. Such closure and seal determine the degree to which the container is airtight and leakproof, important attributes for storage containers. The art is replete with different closure designs.

In considering container design, price and value, and sometimes price alone, often drive the container design; the materials used; and the ultimate construction and performance of storage containers. There are often trade-offs in the quality of the container design and the intended use of the container. Additionally, the increased cost of resin has made container design important to optimize the use of resin while concurrently providing a quality container.

Many types of storage containers are available in the marketplace, including for food storage. These containers generally fall under several categories including (1) durable containers, such as Rubbermaid® containers and Tupperware® containers; (2) semi-durable containers which are disposable after a few uses, such as Ziploc® containers; and (3) single use containers made of plastic or paper. Each of these types of containers has benefits and drawbacks depending on the intended use by the consumer.

More particularly, durable containers are not disposable. They are generally sturdy and rigid such that the container and the lid hold their shape and tend to have a secure closure and seal so that the container is airtight and leakproof. Durable containers are usually microwave, freezer and dishwasher safe. They must be washed after each use. However, durable containers may be difficult to open because of the rigidity and generally secure seal usually formed. Also durable containers tend to be more expensive to manufacture because of the type and the amount of material used to make the container. Accordingly, this cost is then passed on to the consumer, thereby making durable containers more expensive and subject to certain long term use but not short term or disposable uses.

Semi-durable containers are reasonably strong and may be reused multiple times before disposal. These containers when new tend to be leak-resistant or leakproof. They are usually airtight. Semi-durable containers usually do not have as secure of a closure and seal as durable containers. Also, semi-durable containers may or may not be microwave, freezer and dishwasher safe. Accordingly, semi-durable containers are generally less expensive to manufacture and, therefore, less expensive to consumers. As such, semi-durable containers are a popular choice among consumers.

However, consumers sometimes use the semi-durable containers similar to the durable containers. For example, consumers tend to use the semi-durable containers more times than their intended lifespan. These multiple uses subject the containers to more dishwasher, freezer and/or microwave exposure than their intended use. In such instances, the containers may become subject to leakage and are no longer airtight. This may affect the freshness of food or other attributes of proper storage. In some cases, this may cause dissatisfaction by the consumer who has purchased the semi-durable container because it is less expensive, but has used the container like a durable container.

The single use disposable containers are generally made of lower cost and lower quality material, and they are less rigid than the durable and semi-durable containers. These containers may not hold the desired shape, especially if the container is heated or pressure is applied thereto. This may cause the lid to pop off the base of the container allowing the contents to spill. However, single use disposable containers are convenient for the consumer since these containers do not have to be washed after use since they are designed and constructed to be thrown away after one use.

Accordingly, there is a need in the market for a storage container which provides benefits of durable containers but has the cost advantages of semi-durable containers.

SUMMARY OF INVENTION

The present invention is directed to lids for storage containers which provide the storage container with certain of the attributes of durable containers but at a lower cost. These attributes include a storage container which is airtight, leakproof and provides for a secure closure through multiple uses. The storage container using the lids of the present invention may be subject to multiple exposures to the dishwasher, microwave, and freezer without losing container durability, including being airtight and leakproof. Additionally, the lids of the present invention provide a pleasing appearance. Yet due to being provided at a lower cost than durable containers, the lids and containers of the invention are disposable when desired.

The lid of the present invention comprises a generally U-shaped closure made of a plastic material for securing to a container base; a center window also made of a plastic material and preferably the same as the U-shaped closure; and a thermoplastic material which provides for a sealing gasket on the underside of the U-shaped closure for mating with the container base and a perimeter seal on the outside of the U-shaped closure and extending around the outer circumference of the center window. The lid may further include a gripping tab made at least in part of thermoplastic material and being a part of the U-shaped closure, in particular in a lid corner thereof when present, for opening or closing the container; and wings made of a thermoplastic material in one or more portions of the U-shaped closure, in particular in one or more of the corners of the lid when present.

In a preferred embodiment, the U-shaped closure and center window of the lid are made of polypropylene as is the container base. The sealing gasket, perimeter seal, gripping tab and wings are made of a thermoplastic elastomer such as thermoplastic vulcanized rubber.

The U-shaped closure may have different geometries. The sealing gasket provides a seal between the lid and container base which contributes to rendering the container airtight and leakproof. This gasket also aids in providing a secure closure to prevent accidental opening of the container. The thermoplastic seal around the outer periphery of the lid window provides added strength to the lid, ease in gripping the lid and allows for a multi-color lid to provide a pleasing aesthetic appeal. The thermoplastic wings provide additional strength and durability to the container lid and ease of gripping when opening and closing the container.

The additional strength and durability of the new lid extends the longevity of the container through multiple uses and exposures to the dishwasher, freezer and/or microwave.

A preferred method of making one preferred embodiment of the lid of the present invention is a three shot molding method. The method comprises a first shot which molds the generally U-shaped closure of a polymer such as polypropylene. The second shot molds a thermoplastic material which fuses to the generally U-shaped closure and which provides the sealing gasket on the underside of the U-shaped closure and the perimeter seal around the outer circumference of the center window. The third shot molds the center window of a polymer such as polypropylene which fuses to the plastic of the first shot and/or the thermoplastic material of the second shot.

The different embodiments of the invention will be apparent from the following description of the preferred embodiments of the invention and from the accompanying drawings.

BRIEF DESCRIPTION OF THE DRAWINGS

The following detailed description of specific nonlimiting embodiments of the present invention can be best understood when read in conjunction with the following drawings, where like structures are indicated with like reference numbers.

DETAILED DESCRIPTION OF THE PREFERRED EMBODIMENTS

Figure 1:
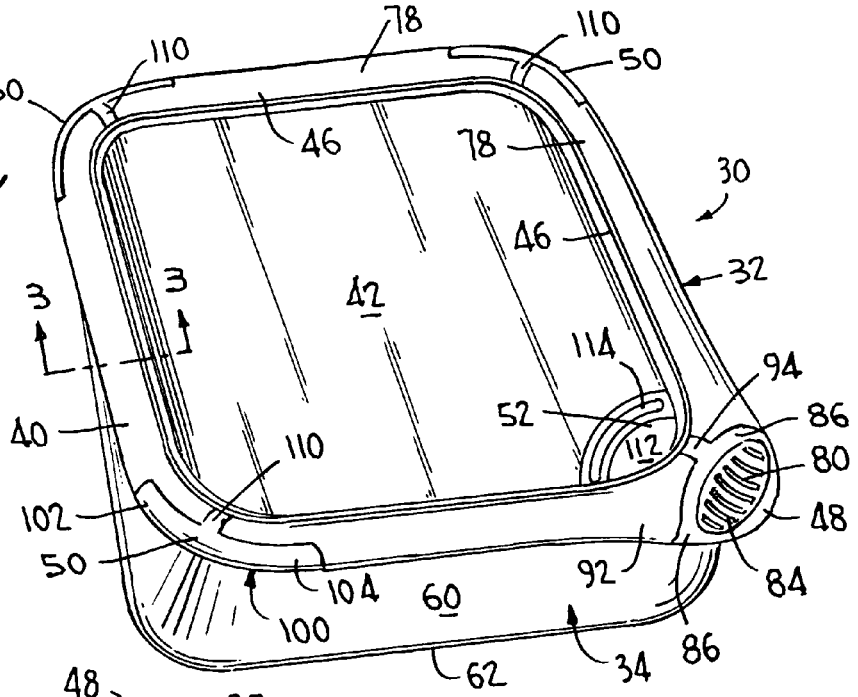
FIG. 1 is a top perspective view of a preferred embodiment of a lid of the present invention with a container base.

FIGS. 1-4 illustrate a presently preferred embodiment of the invention and will be described in detail hereafter. FIGS. 5-25 illustrate alternative embodiments of the invention similar to the invention disclosed in FIGS. 1-4 but with alternative geometries of the closure and/or including additional inventive features. Accordingly, FIGS. 1-4 will be described in detail with the understanding that such description is applicable to the alternative embodiments in FIGS. 5-25 except where otherwise noted or apparent from the specification and drawings.

The container 30 of the invention comprises lid 32 and base 34. The invention is primarily directed to lid 32 to provide a secure closure when mated with base 34, such closure having a seal which renders the container leakproof and airtight. While the container 30 is generally shown in the drawings as rectangular, it is understood that other container shapes work equally well with the lid invention, including square, round, oval or the like and are considered within the scope of the invention.

A primary novel feature of the invention is providing a lid made of at least two different materials, namely a plastic material, and a thermoplastic material. The plastic material is generally hard and the thermoplastic material is softer in comparison to the plastic material and in feel, thereby providing a container of "hard" and "soft" materials which provide benefits to the lid as will be apparent herein, including improved sealing properties, strength and durability. In the preferred embodiment, the plastic material is polypropylene and the thermoplastic material is thermoplastic vulcanized rubber. However, other plastics may be used as known to those skilled in the art including, but not limited to, polyethylene, polyethylene terephthalate, polystyrene, ethylene propylene copolymers, cyclic olefin copolymers, and other suitable polymer materials. Similarly, other thermoplastic materials may be used as known to those skilled in the art including, but not limited to, thermoplastic elastomers or thermoplastic rubbers. Preferably, the thermoplastic material should have characteristics including a Shore A hardness value of thermoplastic rubber materials of 30 to 35; the material is colorable with pigments which are FDA approved for food contact; the material is microwave safe and able to withstand temperature of 300° F. (150° C.); the material is dishwasher and freezer safe and compatible with dishwashing detergents; and the material is compatible with the plastic material used for the remainder of the lid and must adhere thereto.

Referring to FIGS. 1-4, lid 32 includes a general U-shaped closure 40; a center window 42; a sealing gasket 44; and a perimeter seal 46 circumferential to window 42. The lid further includes a gripping tab 48 for opening or closing the lid and wings 50. An extension tab 52 may also be provided for including the brand of the product or other information or ornamentation. Lid 32 provides a secure airtight and leakproof closure with base 34.

The lid 32 may be used with a base 34 having different rim geometries as seen herein. Base 34 generally includes a storage portion having a sidewalls 60, bottom 62 and rim 64. Rim 64 is generally U-shaped and mates with the U-shaped closure 40 of the lid to provide a secure closure. Rim 64 may have various geometries, including, but no limited to, those described herein and as shown in the drawings. Base 34 is preferably made of the same plastic material as lid 32, although the base plastic material may differ from the plastic of the lid without departing from the scope of the invention. A presently preferred plastic for base 34 is polypropylene. Other plastics may be used as known to those skilled in the art including, but not limited to, polyethylene, polyethylene terephthalate, polystyrene ethylene propylene copolymers, cyclic olefin copolymers, and other polymer materials.

Figure 3:
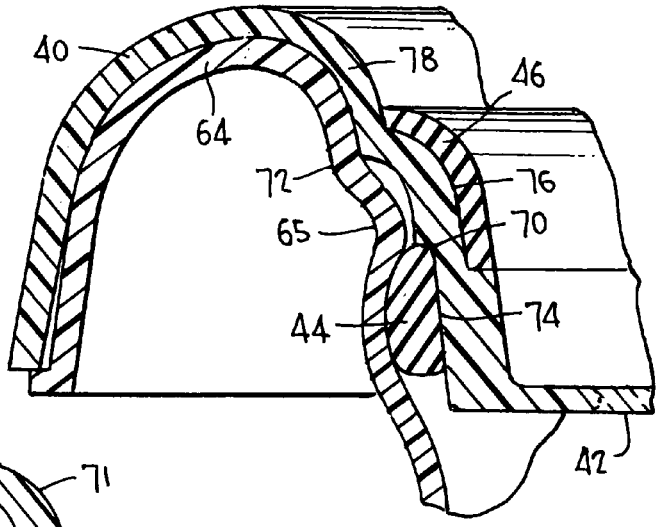
FIG. 3 is a cross-sectional view of the lid and container base of FIG. 1 along line 3-3.
Figure 4A:
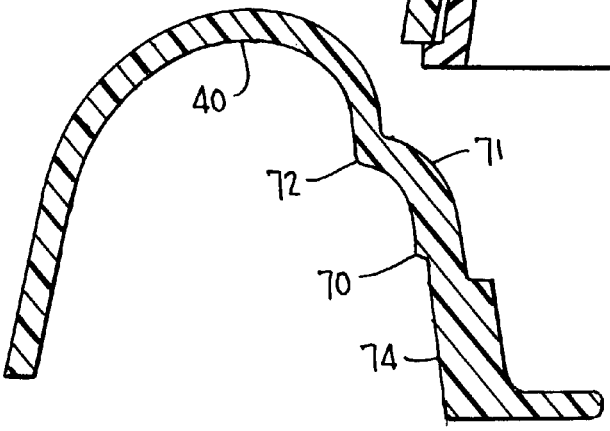
FIGS. 4A-C illustrate the three shot molding of the lid of FIG. 1.
Figure 4B:
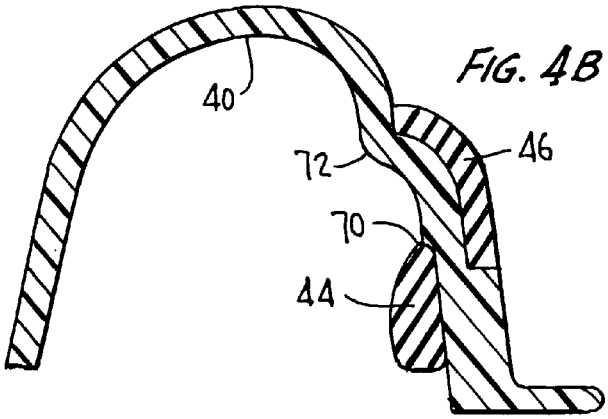
Figure 4C:
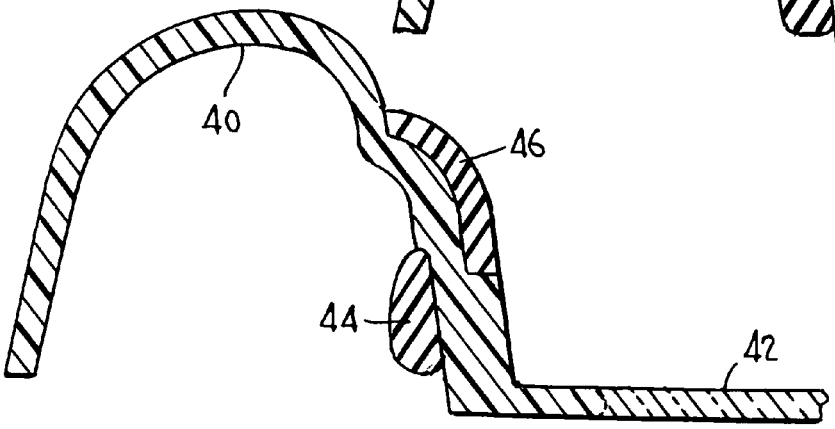

Referring to FIG. 4, lid 32 is shown being made in a three shot molding process. In the first shot, polypropylene forms U-shaped closure 40 as seen in FIG. 4A. The second shot is of the thermoplastic material which forms the sealing gasket 44, perimeter seal 46 as seen in FIG. 4B. The second shot also forms wings 50 and portions of gripping tab 48 and extension tab 52, although not shown in FIG. 4. The third shot is of polypropylene which forms center window 42 as seen in FIG. 4C and providing the completed lid of FIGS. 1-3. The polypropylene and thermoplastic fuse in the molding process to form integral lid 32. The thermoplastic material forming gasket 44 provides for a secure closure of the lid to the base; provides an airtight and leakproof seal; and adds durability and strength to the lid. The thermoplastic material of the perimeter seal 46 provides for strength and durability to the lid; allows for gripping the lid; and may engage the base of another container for stacking of multiple containers.

Use of both a hard plastic material and a soft thermoplastic material may also provide the lid with a pleasing aesthetic appearance. For example, the first shot of polypropylene for the U-shaped closure may be of one color, e.g. blue, providing the U-shaped closure with a blue appearance and the third shot of polypropylene may be a different color and generally transparent, thereby providing the window with a transparent appearance to allow viewing of the stored material. Similarly, the second shot of thermoplastic material may be a contrasting color such as green to provide aesthetic appeal and also identify to the user the sealing and strengthening characteristics of the soft thermoplastic material. While the three shot molding process is a presently preferred method of making the lid of the invention, other processes may be used without departing from the scope of the invention.

Referring again to FIGS. 1-4, closure 40 is generally U-shaped and connects with window 42. While generally U-shaped, closure 40 may include various geometries including having one or more cutbacks. The U-shaped closure 40 will also include one or more sealing and/or closure points, including at gasket 44. Referring to FIGS. 3 and 4, U-shaped closure 40 includes a first cutback 70 and second cutback 72. Gasket 44 mates with the inside surface 74 of closure 40 generally at cutback 70. Similarly, perimeter seal 46 is shaped to mate with the outer surface geometry 76 of closure 40 generally at cutback 72. This construction is applicable to the lids shown in FIGS. 5-22 which include one or more cutbacks and different geometries.

Center window 42 is shown as being substantially flat. However, window 42 may have other shapes, including ridges or means for stacking other lids or container bases or other ornamentation. The window 42 may include the name of the product. Window 42 is preferably substantially transparent to allow the user to see the content stored in the container, especially food products. The window preferably has a color which contrasts with U-shaped closure 40. However, it may be desirable in some instances to have a translucent or opaque window and the color may be the same as closure 40.

Figure 2:
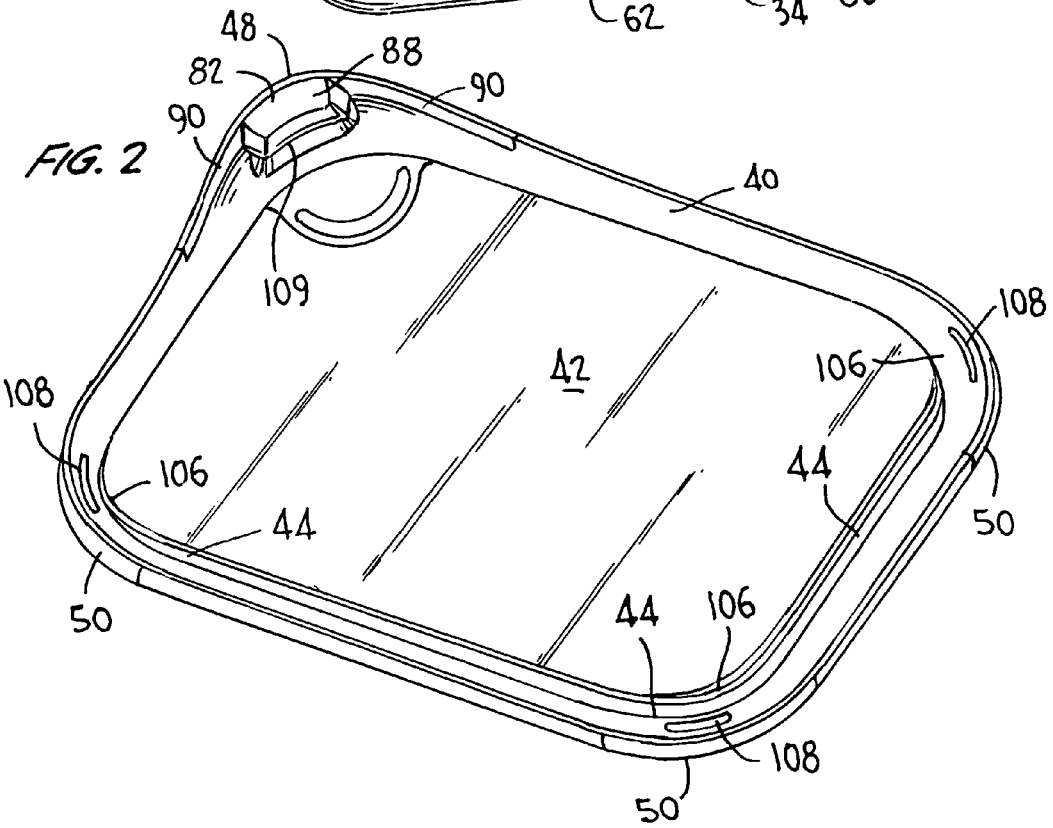
FIG. 2 is a bottom plan view of the lid of FIG. 1.

Referring to FIGS. 2 and 3, gasket 44 extends around the inside periphery of closure 40. Gasket 44 has a geometry which mates with the inside geometry of U-shaped closure 40 and with the outside geometry of rim 64 of base 34. Rim 64 may have one or more cutbacks which mate with the cutbacks of closure 40 to provide a closure and/or a sealing point. For example, referring to FIG. 3, rim 64 includes cutback 65 which mates with gasket 44. Thus, gasket 44 is constructed to provide a seal with lid 32 and base 34 such that the seal aids in rendering the storage container substantially airtight and leakproof. The seal also provides a secure closure to prevent accidental opening of the container. Additionally, gasket 44 when of a color different from the plastic of the lid may provide visual indication to the consumer of the seal. Also, when the lid is being secured to the base, gasket 44 may provide an aural indication of closure such as a "snap" or "click". Similarly, the soft nature of the thermoplastic mating with the hard plastic of the base will provide the user with a "feel" that the lid is secure to the base.

Referring to FIGS. 1 and 3, perimeter seal 46 extends around the periphery of inside wall 78 of U-shaped closure 40 and adjacent to center window 42. Perimeter seal 46 is of a geometry which mates with the outer surface 76 of U-shaped closure 40. Seal 46 provides additional strength and durability to the lid. Due to the soft nature of the thermoplastic material, perimeter seal 46 also may provide means for gripping the lid when handling the lid. The gripping surface area will vary depending on the geometry of the perimeter seal 46. For example, the surface area of perimeter seal 46 is much greater in the lids shown in FIGS. 5 and 6 than the lid in FIG. 3.

Gripping tab 48 extends outwardly from a corner of lid 32 a sufficient distance to allow the user to engage recess 80 on the top with one's thumb or finger and engage the underside portion 82 of the tab with a finger or thumb to lift the tab to open the container or the push down on the tab to close the container. The recess portion 80 of the tab is preferably polypropylene and may include a rib design 84 underneath the outer surface of recess 80. The recess portion 80 may be provided with a contrasting finish to the surrounding area to provide a different tactile effect, e.g. a matte finish to provide a "soft" feel. The outer portion 86 of the tab surrounding recess 80 is comprised of thermoplastic material. Underside portion 88 of the tab is also comprised of thermoplastic material. The thermoplastic material extends outwardly along inside edges 90 of U-shaped closure 40. The thermoplastic material provides for ease of gripping the tab 48 due to the softness of the thermoplastic material, and also provides strength and durability to the gripping tab. The thermoplastic material along edges 90 also provides strength and rigidity to the gripping tab. It is understood that the thermoplastic material may be configured differently at the gripping tab 48 without departing from the scope of the invention. For example, the thermoplastic material may extend varying distances along edges 90 and/or may also be on the outside edges 92 of U-shaped closure 40. The thermoplastic material also extends inwardly from tab 48 along the top portion 94 of U-shaped closure 40 to join perimeter seal 46. In the three shot molding method, the thermoplastic material at finger tab 48 is molded in the second shot.

Wings 50 are provided at the corners of the lid and made of the thermoplastic material to provide additional strength and durability to the lid. Wings 50 also provide for ease of gripping the lid at the corner. The corners of the lid receive more stress than other portions of the lid leading to cracking in the prior art lids or lid failure. Wings 50 address this issue and add longevity to the lid. As seen best in FIG. 1, wings 50 extend from the outside corner portion 100 of U-shaped closure 40 along the outer periphery 102 and 104 and away from the corner. Along the inside edge 106 of U-shaped closure 40 are ribs 108 to provide additional strength and durability to the lid. The underside of ribs 108 also engage the corner of base 34 to aid in securing the lid to the base. The inside wall 109 of gripping tab 48 preferably is shaped to include a projection or rib so as to engage a rim or cutback of base 34 to provide a "snap-fit" for additional strength and durability. The thermoplastic material extends inwardly along the top portion 110 of the U-shaped closure 40 to join perimeter seal 46. In the three shot molding method, the thermoplastic material for wings 50 is molded in the second shot.

Wings 50 of the thermoplastic material are substantially flush with outside walls of the plastic U-shaped closure 40. This provides for a preferred smooth finish which avoids getting caught on other materials, prevents the collection of dirt or other unwanted material thereat, and provides a pleasing appearance. However, it is within the scope of the invention that the wings may be raised somewhat from the plastic of the U-shaped closure. Additionally, the wings may extend along the entire outside wall of U-shaped closure 40 or any portion thereof. However, the greater the extension of the wings, the greater will be the cost of the lid and the weight of the lid.

Extension tab 52 extends inwardly into window 42 and the top portion 112 is made of thermoplastic material. As shown for example in FIG. 1, it is semi-circular in shape and surrounded by a ridge 114 of plastic material. The tab 52 may include, among other things, a brand name, other information or an ornamental design. Tab 52 may be of any shape. While preferably having the thermoplastic portion 112 (e.g. to provide a contrasting look and feel), tab 52 may be, alternatively, only made of plastic material.

As seen from the drawings, lid 32 fits on the base 34 in any orientation, although it is possible to make the lid and base such that the gripping tab 48 and corners only fit in a single orientation.

Figure 5:
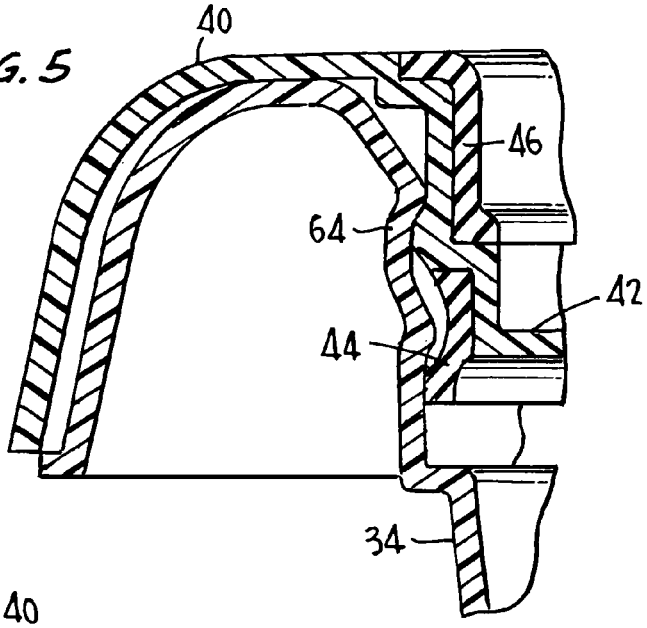
FIGS. 5-8 are cross-sectional views of further embodiments of the lid of the present invention with a container base.
Figure 6:
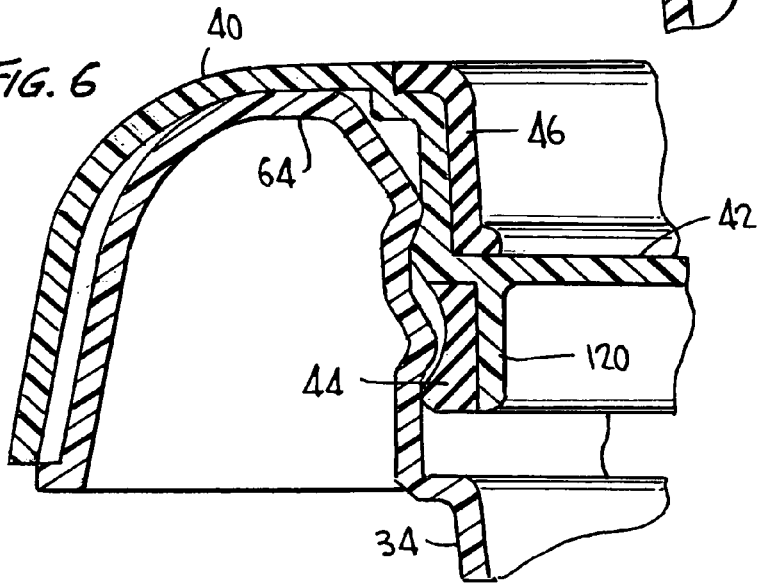
Figure 7:
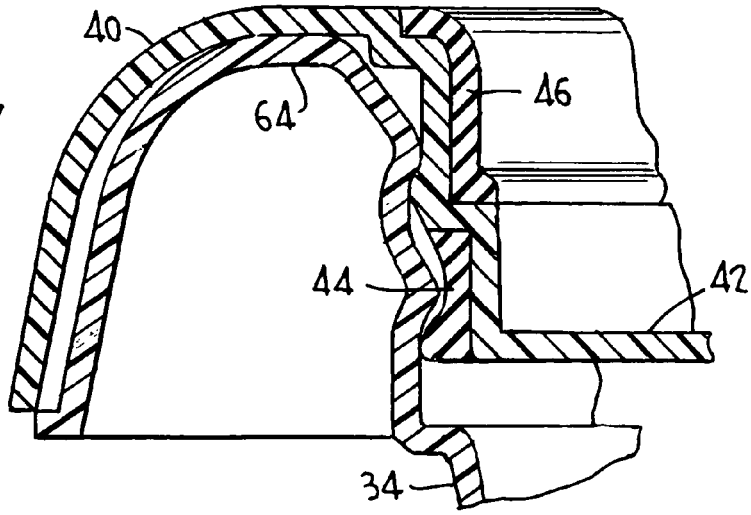

FIGS. 5-8 are cross-sections of lid 32 and base 34 similar to FIG. 3 and illustrating alternative embodiments of lid 32. Each lid includes U-shaped closure 40; center window 42; gasket 44; and perimeter seal 46. As shown in the drawings, the geometries of these alternative embodiments are different, primarily having different cutbacks and, therefore, having different geometries in the corresponding gaskets 44 and perimeter seals 46. Similarly, the geometries of rim 64 of base 34 are different and correspond generally to the geometries of lid 32 for closure and securing lid 32 to base 34. For example, the embodiments of FIGS. 5-7 show perimeter seal 46 having a greater surface area extending to the top of closure 40. Similarly, gasket 44 has a different geometry dependent in part on the cutbacks on the inner wall of closure 40. In FIGS. 5 and 7, gasket 44 extends further downward than the gasket in the lid in FIG. 3 and the rim 64 of the base has a different cutback geometry to engage gasket 44 to form the closure and seal for the container. In FIG. 6, an annular leg 120 extends downwardly from window 42 and gasket 44 is fused thereto.

Figure 8:
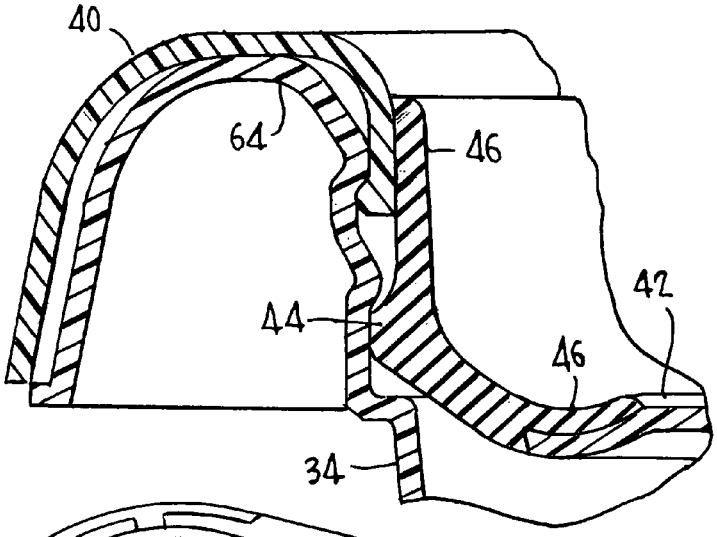

Referring to FIG. 8, U-shaped plastic closure 40 and plastic window 42 are not physically joined and are connected by thermoplastic perimeter seal 46 forming an integral lid 32. The gasket 44 is provided in the shape of the bridge portion of the thermoplastic material which interacts with a portion of rim 64 to provide a seal point between the lid 32 and base 34.

Figure 9:
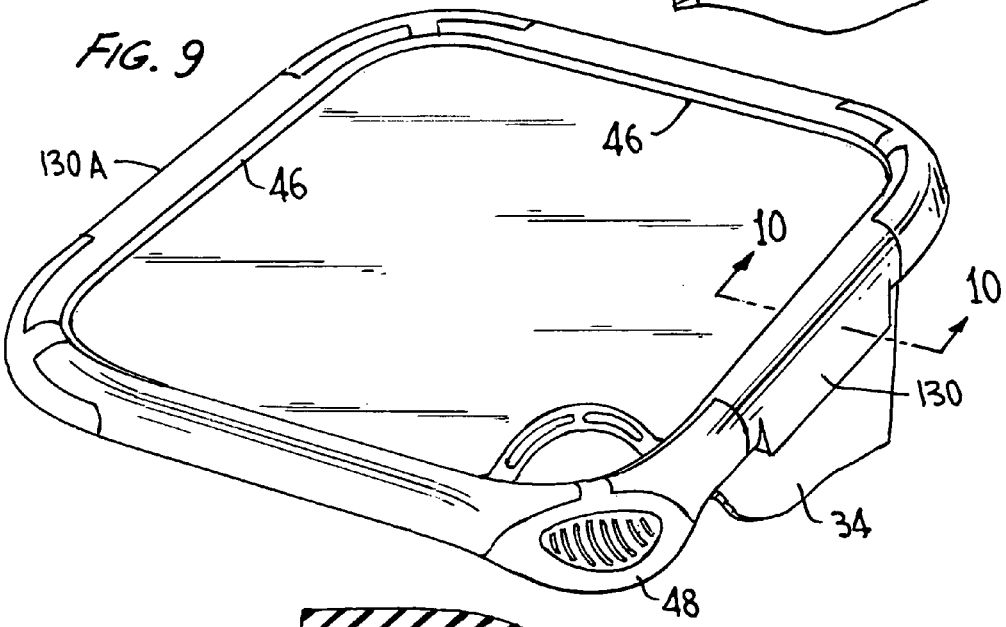
FIG. 9 is a top perspective view of another preferred embodiment of a lid of the present invention having a locking member for securing the lid to a container base.
Figure 10:
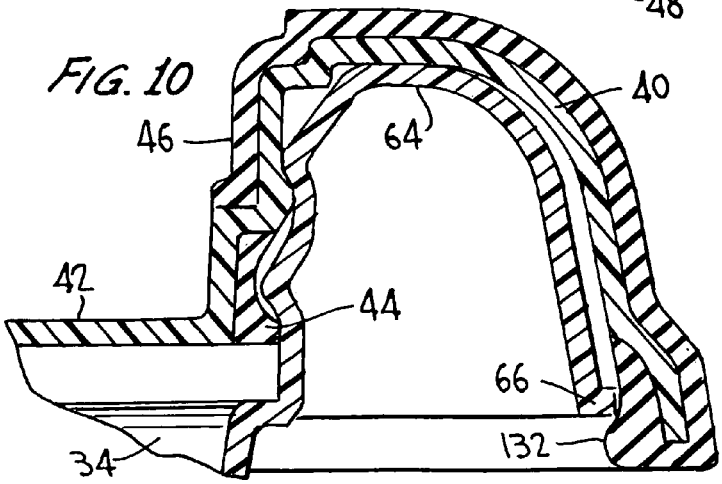
FIG. 10 is a cross-sectional view of the container of FIG. 9 along line 10-10.
Figure 11:
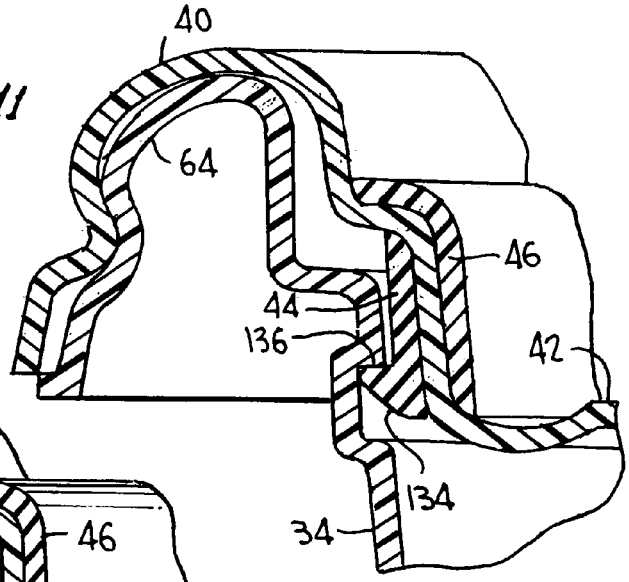
FIGS. 11-15 are cross-sectional views of further embodiments of the lid of the present invention with a container base.
Figure 12:
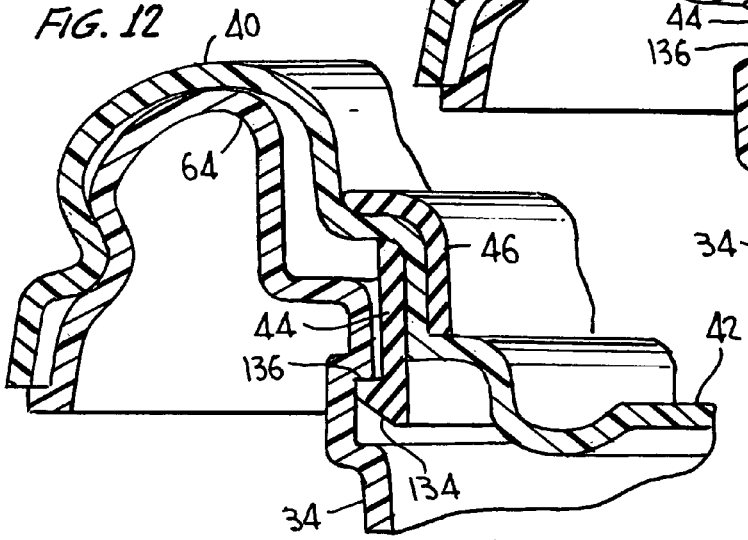
Figure 13:
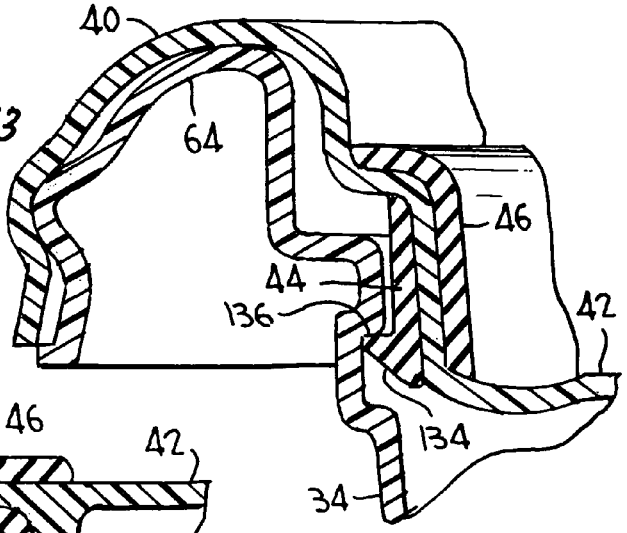
Figure 14:
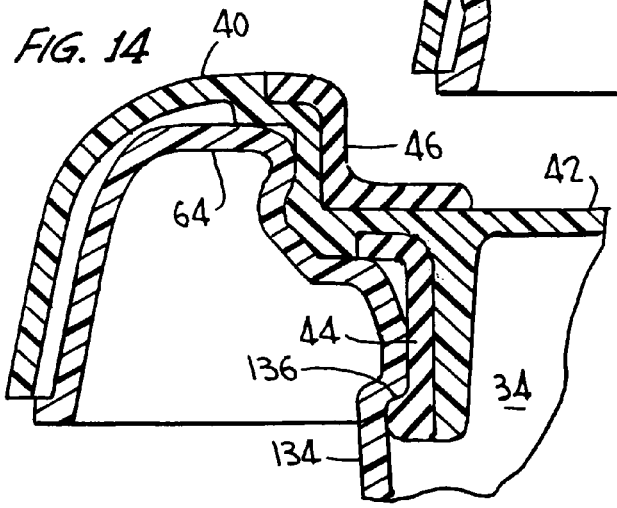
Figure 15:
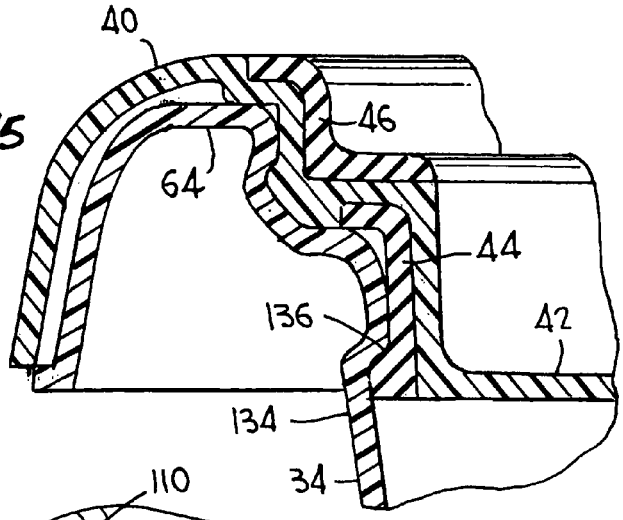

Referring to FIGS. 9 and 10, an alternative embodiment of lid 32 is disclosed having a locking member 130 which has a lip 132 which fits under rim edge 66 of the base. This aids in securing the lid to the base. As seen in the drawing, the thermoplastic of perimeter seal 46 extends from the perimeter of the window 42 and over closure 40 to provide the entire exterior of locking member 130 such that thermoplastic material engages rim edge 66. Additionally, the U-shaped closure 40 opposite locking member 130 is also provided with a locking member 130A.

FIGS. 11-15 are cross-sections of lid 32 and base 34 similar to FIG. 3 and illustrating alternative embodiments of lid 32. Each lid includes U-shaped closure 40; center window 42; gasket 44; and perimeter seal 46. As shown in the drawings the geometries of these alternative embodiments are different, primarily having different cutbacks and, therefore, having different geometries in the corresponding gaskets 44 and perimeter seals 46. Similarly, the geometries of rim 64 of base 34 are different and generally correspond to the geometries of lid 32 for closure and securing lid 32 to base 34. As apparent from these FIGURES, the geometries of gasket 44 and perimeter seal 46 generally correspond to the cutbacks of lid 32 and base 34. Additionally, for example, FIGS. 11-15 illustrate gasket 44 having a foot member 134 engaging a corresponding cutback 136 of the rim 64 for closing and sealing the lid to the container.

Figure 16:
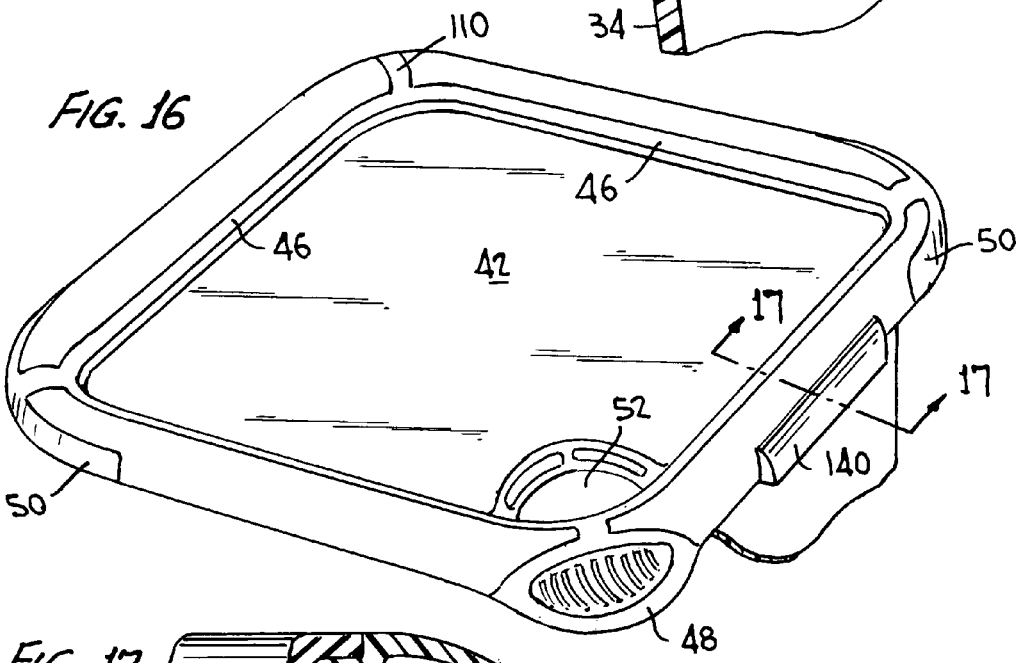
FIG. 16 is a top perspective view of another preferred embodiment of a lid of the present invention having a locking member for securing the lid to a container base.
Figure 17:
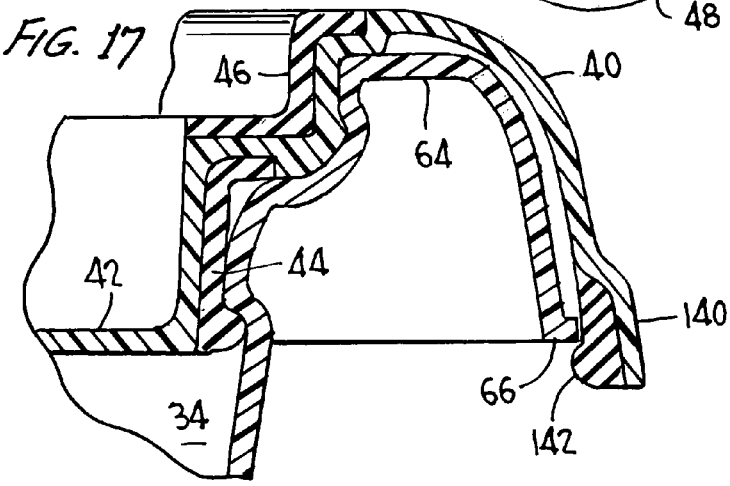
FIG. 17 is a cross-sectional view of the container of FIG. 16 along line 17-17.

Referring to FIGS. 16 and 17, an alternative embodiment of lid 32 is disclosed having a locking member 140 which has a lip 142 which fits under edge 66 of rim 64 of the base. This aids in securing the lid to the base. Locking member 140 is made of plastic and formed during the first shot of the preferred molding process. Lip 142 is made of thermoplastic material and formed during the second shot of the preferred molding process. The soft thermoplastic lip 142 provides for a secure closure and gives the consumer the "feel" of closure when secured to rim edge 66.

Figure 18:
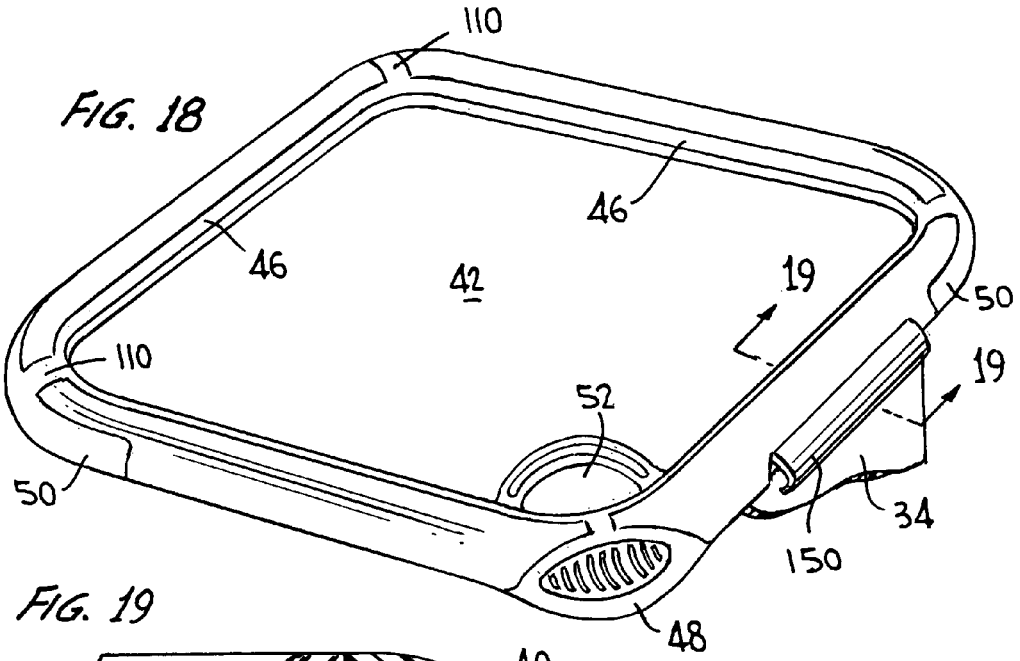
FIG. 18 is a top perspective view of another preferred embodiment of a lid of the present invention having a locking member for securing the lid to a container base.
Figure 19:
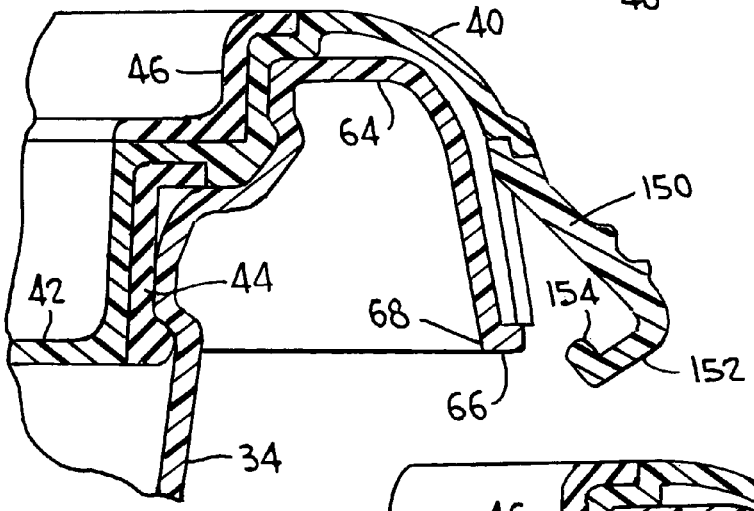
FIG. 19 is a cross-sectional view of the container of FIG. 18 along line 19-19 illustrating the locking member in an open position.
Figure 20:
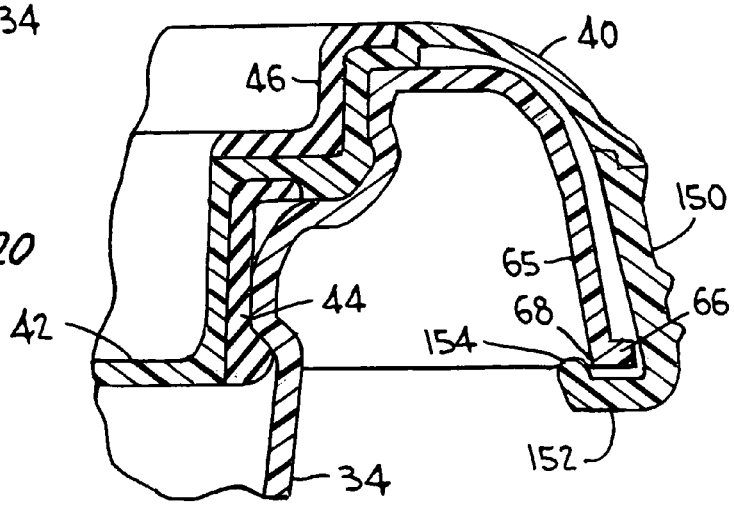
FIG. 20 is a cross-sectional view of the container of FIG. 18 except that it illustrates the locking member in a closed position.

Referring to FIGS. 18-20, an alternative embodiment of lid 32 is disclosed having a pivoting locking member 150 made of thermoplastic material and which joins the plastic portion of U-shaped closure 40. Locking member 150 has a lip 152 and hook member 154 which fits under rim edge 66 of the base. Member 154 engages the inside portion 68 of base 34 to secure locking member 150 to the base as shown in FIG. 20. FIG. 19 illustrates pivoting locking member 150 in an open position and FIG. 20 illustrates pivoting locking member 150 in the closed position.

Figure 21:
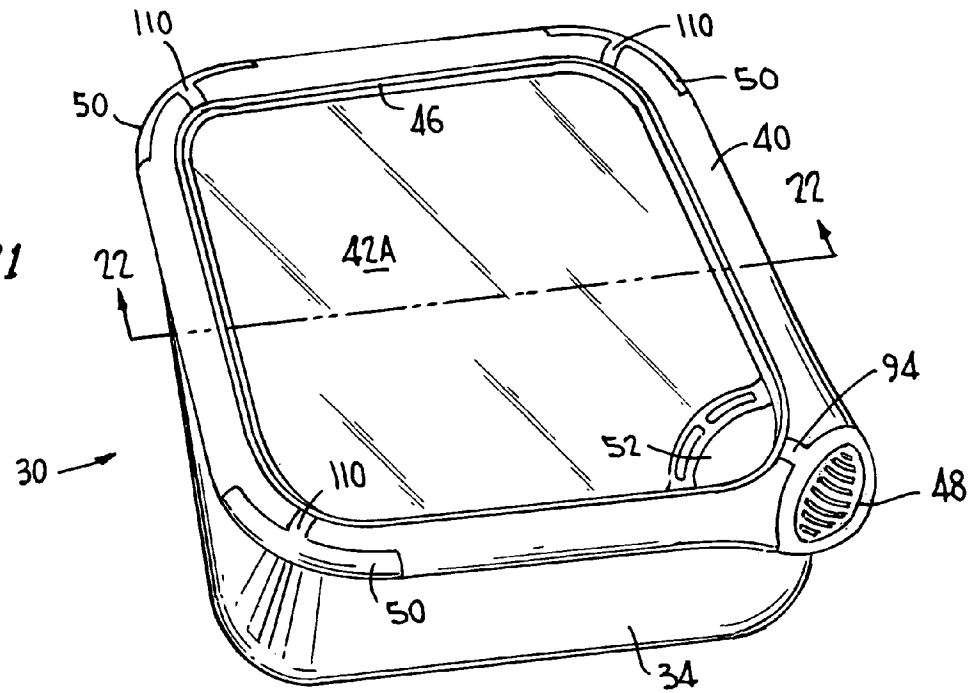
FIG. 21 is a top perspective view on another embodiment of a lid of the present invention.
Figure 22:
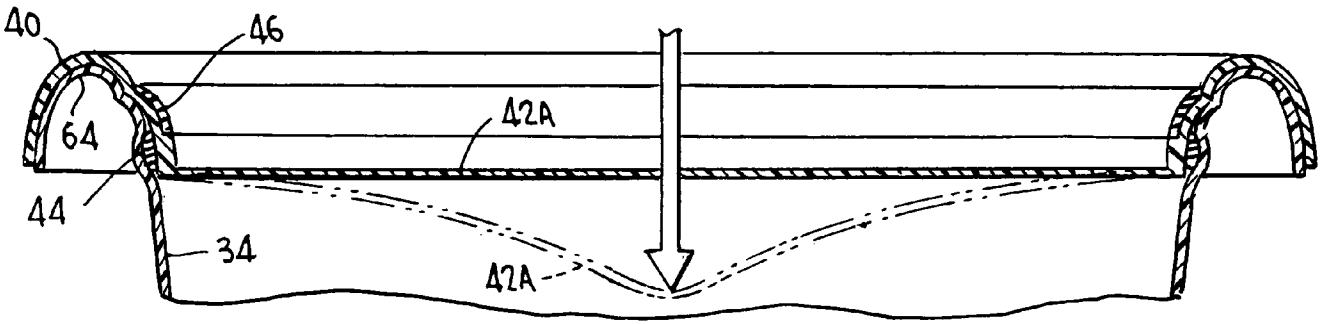
FIG. 22 is a cross-sectional view of the container of FIG. 21 along line 22-22 showing a flexible center window of a lid of the present invention.

Referring to FIGS. 21 and 22, an alternative embodiment is disclosed where lid 32 includes a window 42A made of an elastic material such as thermoplastic elastomers, thermoplastic urethanes, silicone elastomers, and the like, and is flexible as shown in FIG. 22. The flexibility of window 42A necessarily is in either direction, i.e., either inward (as shown in FIG. 22) or outward (in the opposite direction to that shown in FIG. 22). Inward flexibility allows the lid to be used with a base which may have a vacuum drawn in the interior thereof and the lid to then adapt to fill the empty head space of the base upon drawing of the vacuum therein. Outward flexibility of window 42A allows the lid to "give" or adjust when the base is filled with material which exceeds the upper limit of the base and thereby achieve and maintain a seal between the lid and base.

Figure 23:
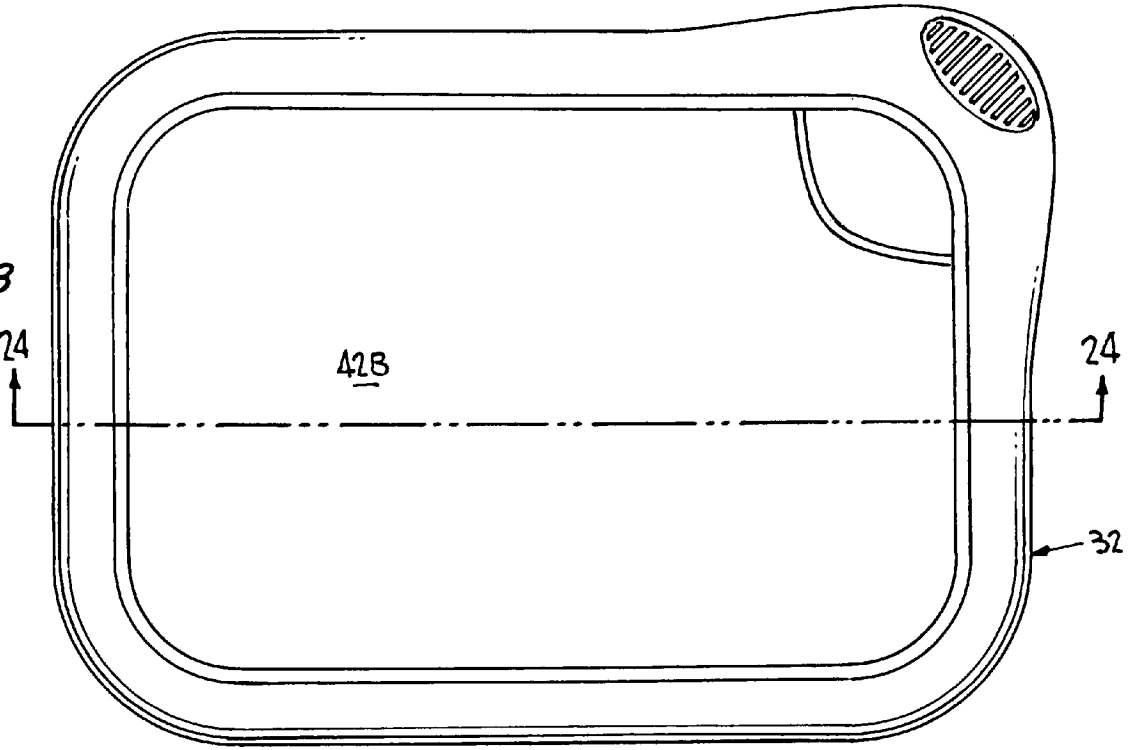
FIG. 23 is a top perspective view of another preferred embodiment of a lid of the present invention.
Figure 24:
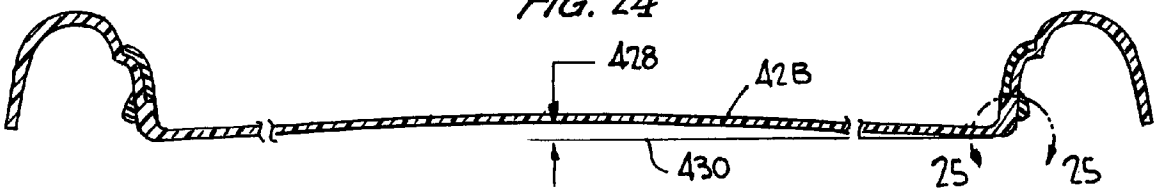
FIG. 24 is a cross-sectional view of the lid of FIG. 23 along line 24-24 showing a domed center window of the lid of the present invention.
Figure 25:
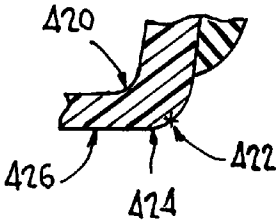
FIG. 25 is an enlargement of detail 25 of FIG. 24.

Referring to FIGS. 23, 24, and 25, an alternate embodiment of lid 32 is disclosed wherein window 42B has an upward curvature or a dome shape. The dome shape begins in the peripheral area 420 of the center window 42B as shown in FIGS. 24 and 25 at tangent point 422 through transition 424 into and beginning at dome radius point 426 shown in FIG. 25. The dome configuration in the embodiment shown in FIGS. 23-25 includes a center window of uniform thickness which, at the center portion 428, is approximately 0.218 inch in height greater than the dome radius at 426. The difference in height, and amount of flexure provided by the dome shape, is shown by the space between line 430 and window 42B. The dome height from the dome radius 426 to the center of the dome 428 is variable so long as a surface is provided having a curved continuity along the radius of the dome to the frame so that at or near the frame is minimal or no deflection, whereas the center 428 of the surface has deflection. Having a dome in the center window will allow creation of a vacuum when the lid is attached to the base by pushing the dome inward which provides certain benefits to the container including, but not limited to (1) the vacuum will increase the strength of the seal of the lid to the base; (2) the vacuum will help prevent liquid from leaking out of the closed container; and (3) the vacuum will allow the consumer to sense the formation of the vacuum when closing the lid and the release of the vacuum when opening the lid indicating aurally the functioning of the closure and seal. When the lid is removed from the base (i.e. the container opened) the dome reverts or pops back to its original configuration. To get a higher spring force in the center window, the window can be provided with areas of different thicknesses and thinness e.g. the inner area as to the circumferential area of the window. The dome upon a pressing-in motion on the center of the dome has a portion which goes concave down and as move from the center to the periphery or frame of the lid, has a neutral inflection and then goes concave up. The inflection point provides for the movement downward as well as storage of energy which will revert the window back to its original shape. Variation in the thickness, or areas of thickness, of the center window moves the location of the inflection point so that adjustment in the deflection can be provided. An infinite combination of thicknesses and thinness (both as to size and configuration of such areas) of the center window surface (i.e., to provide a non-uniform surface) is possible to adjust characteristics of the deflection and resulting effects obtained.

Additionally, the dome affects the optics of the lid as it changes the way light passes through the center window thereby providing greater magnification for seeing the contents of the container. In some instances, the dome center window may be preferred over a flat center window. For example, in the molding process, the center window in some instances may not be uniformly flat which may be perceptible to the consumer. By use of the domed center window, the container has the above-referenced advantages and the manufacturer need not be concerned about uniformity in the flatness of the lid. Further, the dome allows for deviation due to shrinkage during the manufacturing process.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

We claim:

1. A storage container lid comprising a substantially U-shaped closure made of a plastic material structured to secure the lid to a container base, a center window made of a plastic material, a one piece combined gasket and perimeter seal structure joining said U-shaped closure and said center window, wherein said one piece combined gasket and perimeter seal structure is made of a thermoplastic material and is structured to serve as (1) a sealing gasket positioned below said U-shaped closure and configured to mate with a vertical wall portion of the container base when the lid is sealingly seated on the container base, and (2) a perimeter seal on an outside portion of the U-shaped closure and configured to extend around the outer circumference of the center window, and wherein said one piece combined gasket and perimeter seal structure is fused to said U-shaped closure and to said center window at respective ends of said one piece combined gasket and perimeter seal structure to join together said U-shaped closure and said center window;

wherein said plastic material of said U-shaped closure is a hard plastic material and said thermoplastic material of said one piece combined gasket and perimeter seal structure is soft in comparison to said plastic material.

2. The storage container lid of claim 1 wherein the substantially U-shaped closure further comprises as a part thereof a gripping tab made at least in part of a thermoplastic material and constructed and arranged for opening and closing the container.

3. The storage container lid of claim 2 wherein the gripping tab includes a recessed portion.

4. The storage container of claim 2 further comprising wing members made of thermoplastic material located adjacent said gripping tab.

5. The storage container lid of claim 2 wherein the container lid is at least substantially square or substantially rectangular and further comprises wing members made of a thermoplastic material located at one or more corners of the lid.

6. The storage container lid of claim 4 further comprising an extension tab extending inwardly from said gripping tab and constructed and arranged for receiving a brand name or ornamentation.

7. The storage container lid of claim 6 wherein the extension tab is made at least in part of a thermoplastic material.

8. The storage container lid of claim 1 wherein any one or all of the plastic material comprises polypropylene and any one or all of the thermoplastic material comprises a thermoplastic elastomer.

9. The storage container lid of claim 1 wherein any one or all of the plastic material is a different color than any one or all of the thermoplastic material.

10. The storage container lid of claim 1 wherein the substantially U-shaped closure has at least one cutback constructed and arranged for mating with at least one complementary cutback on the container base when the lid is sealingly seated on the container base.

11. The storage container lid of claim 1 further comprising a locking member constructed and arranged to engage the container base when the lid is sealingly seated on the container base.

12. The storage container lid of claim 11 wherein the locking member is made at least in part of a thermoplastic material.

13. The storage container lid of claim 1 wherein the center window comprises a dome configuration.

* * * * *